US005193319A

United States Patent [19]

Claassen et al.

[11] Patent Number: 5,193,319

[45] Date of Patent: Mar. 16, 1993

[54] ROOM-SPACE PARTITION MADE OF DISPLACEABLE WALL ELEMENTS

[75] Inventors: Herbert Claassen, Barbel; Werner Klein, Wilhelmshaven; Manfred Radmacher, Oldenburg-Metjendorf, all of Fed. Rep. of Germany

[73] Assignee: Huppe Form Sonnenschutz- und Raumtrennsysteme GmbH, Fed. Rep. of Germany

[21] Appl. No.: 738,107

[22] Filed: Jul. 30, 1991

[30] Foreign Application Priority Data

Aug. 17, 1990 [DE] Fed. Rep. of Germany ..... 4026098

[51] Int. Cl.[5] ..... E04H 1/00

[52] U.S. Cl. ..... 52/243.1; 52/238.1

[58] Field of Search ..... 52/243.1, 238.1, 64

[56] References Cited

U.S. PATENT DOCUMENTS

| | | | |
|---|---|---|---|
| 3,298,143 | 1/1967 | Rogers et al. | 57/243.1 X |
| 3,683,100 | 8/1972 | Deal et al. | 52/243.1 X |
| 4,205,498 | 6/1980 | Unayama | 52/243.1 |
| 4,535,578 | 8/1985 | Gerken | 52/243.1 |
| 4,972,634 | 11/1990 | Dresden | 52/243.1 X |

FOREIGN PATENT DOCUMENTS

54733/80 7/1981 Australia .

8509040 6/1986 Fed. Rep. of Germany .

*Primary Examiner*—David A. Scherbel
*Assistant Examiner*—Creighton Smith
*Attorney, Agent, or Firm*—Merchant, Gould, Smith, Edell, Welter & Schmidt

[57] ABSTRACT

Given is a formed partition made of displaceable wall elements that are suspended, by means of carrier studs, on two carrier members that are displaceable in guide rails, and movable along their perpendicular interfaces in sealing contact against one another and/or against terminal elements. Situated on the horizontal interfaces of the wall elements are sealing strips that are capable of being extended in contact against the floor and/or the guide rails or the ceiling of the room. On one of the wall elements, one of the carrier studs is journaled in horizontally-displaceable fashion toward the other carrier stud. In order to be able to execute a simple and rapid transport of the wall elements, even diagonally, running in the guide rail is a drivable endless element to which are fixed, at a predetermined interval apart, two followers. Disposed on the carrier members are vertically-extendable follower pins, which, in the extended position, come into engagement with the followers and are then transported by the endless element along the guide rail.

15 Claims, 7 Drawing Sheets

ROOM-SPACE PARTITION MADE OF DISPLACEABLE WALL ELEMENTS

DESCRIPTION

The invention concerns a room-space partition made of displaceable wall elements that are suspended, by means of carrier studs, on two carrier members that are displaceable in guide rails, and rotatable about the carrier studs, and movable along their perpendicular interfaces in sealing contact against one another and/or against terminal elements while, along their horizontal interfaces, sealing strips are extendable in contact with the floor and/or with the guide rails or ceiling of the room, with one carrier stud on each wall element being journaled in horizontally-displaceable fashion toward the other carrier stud.

A room-space partition of this kind is known from DE-OS 24 04 875, where driven in each wall element are two shafts that pass through the carrier studs, with each one carrying at the top end a pinion that engages, inside the guide rail, into a chain or gear rack attached, therefore fixed, thereto. Supplying of power for the drive is accomplished via slider contacts and power rails. In the event that the guide rails run diagonally in order to produce a wall corner in the room-space partition, provided at the corner is a turntable that the travelling carriages steer around from one section of rail into the other. In order to move a wall element diagonally, the leading travelling carriage in the direction of travel first travels onto the turntable; next, travelling movement is stopped and the turntable turns the leading travelling carriage in the direction of the new section of rail. Next, travelling movement is resumed until the rear travelling carriage runs onto the turntable; the travelling movement again stops so that the rear travelling carriage can now also be turned in the new direction. Required for doing this is that the two pinions be driven via an electric slippage motor, so that the difference in speed required for travelling diagonally can adjust itself automatically. This known type of construction, which provides for a fixed chain along with power rails in the guide rails as well as a costly individual drive in the wall elements, is relatively expensive.

Further known from DE-OS 38 02 113 is a room-space partition made of displaceable wall elements wherein provided along the guide rails at a predetermined distance apart are friction wheels that drive the wall elements.

Additionally, the wall elements can be coupled with one another by means of a connecting element, and provided at a corner location are endless elements that come into engagement with the wall elements via a friction-fit and, with the diagonal control arrangement, make possible the compulsorily-occurring, different running speeds for the running members by means of a friction-fit between the wall elements and the endless elements.

Disadvantageous in the case of this construction is that all wall elements can only be transported coupled together. Individual wall elements can not be conveyed in this manner.

The object of the invention is to further develop a room-space partition of the initially mentioned type such that, with a simple construction, a reliable transport of individual wall elements—even diagonally—is possible.

This objective, in the case of the room-space partition of the initially-mentioned type, is met in accordance with the invention by the fact that, revolving in the guide rail, is a drivable, endless element to which are fixed, at a maximal distance from the carrier studs of a wall element, two followers, and that there are arranged on the carrier members vertically-extendable follower pins which, in the extended position, come into releasable engagement with the followers.

The advantages of the invention lie particularly in the fact that an endless element revolves over the entire length of the guide rails, hence also over a possibly-desired corner connection, and that the individual wall elements can be brought into engagement with followers of the endless element via extendable follower pins such that the wall element of concern can be transported by the endless element along the guide rail. When conveying diagonally, the change in direction of the running rollers is prescribed by the endless element. Essential here is that one of the two carrier studs of one each of the wall elements be journaled to be horizontally movable. By means of this feature, it is possible to convey a wall element diagonally, while at both carrier members—applied by the endless element—a speed of a constant amount attacks, in different directions, at both carrier members, with the distance between the two carrier members being reduced at the beginning of the diagonal movement and next being increased to the maximum interval. Under the conditions in accordance with the invention that the speed of the two carrier members be, in each case, constant in the direction of the section of rail of concern (namely, corresponds to the pulling speed of the endless element), and that the relative positions of the two carrier members with respect to each other can be freely set only during movement, a rapid diagonal movement of the individual wall elements can be realized, which has the essential advantage that, while dispensing with turntables, the wall elements can be transported in continuous fashion. The usual stopping of the wall elements twice when using turntables in order to be able to turn the running member on the turntable, respectively in the direction of the next section of rail, can drop away.

In accordance with the present invention, resulting is a robust, simple construction that enables a rapid assembly and disassembly, with only a comparatively small number of motors being required, and the high costs of the turntables and their expensive controls can be completely eliminated.

According to a particularly preferred form of embodiment of the invention, running in the guide rail is only that stringer of the endless element that is carrying the wall element along. The counter-running stringer of the endless belt is guided out from the guide rails at the end positions of the guide rails, to run back parallel to the guide rail from one reversal point to the other reversal point.

Particularly preferred, the stringer of the endless belt running within the guide rail runs in a downwardly-open slide profile, which enables a precise guidance of the endless element, and, in particular, prevents the undesirable sagging of the endless element. The endless element, respectively the follower attached to the endless element, project downwardly from the slide profile and carry along with them in the direction of pulling the upwardly extended follower pins.

Preferably, the endless element is constructed as an endless chain, which has the required tensile strength and is not stretchable. Particularly preferred, the endless chain is constructed as a roller chain that can be reversed via reversing pinions at the beginning and end of the guide rail as well as being easily turned at a corner turning. Alternatively used as an endless element can be a cable or a belt.

According to a preferred form of embodiment of the invention, the follower pins are actuated by the sealing drive that is provided in each wall element and that drives the horizontal sealing strips out and in. Preferably, movement of the follower pins is done coupled with the movement of the sealing strips, and, actually, the follower pins are moved out simultaneously with moving in the sealing strips. The wall element is then uncoupled from the floor and the ceiling; it can run freely in the guide rails. Then, if a control command is given for conveying the wall element, the endless element is then set into movement and the followers grip back of the extended follower pins and transport the wall element in the direction of movement of the endless element.

Disposed at the initial position and end position of the room-space partition are preferably wall-fast switch contacts which, upon actuation by wall elements, stop the wall element drive. Additionally, the sealing drive is actuated when a wall element runs up against a termination element or an already-stopped wall element. By this means, the sealing strips are extended against floor and ceiling and/or guide rails. Simultaneously, the follower pins are retracted, so that the followers are then out of engagement with the follower pins. Next, the endless element can again be activated until the follower pair, or another follower pair attached at another point of the endless belt, takes over the next wall element from a magazine that is known per se.

A magazine of this type contains two sections of guide rails that run parallel to one another at a maximum distance from the two carrier studs of a wall element, and branch off at the end of the guide rail at a right angle thereto. Revolving in both rail sections of the magazine are endless elements on which are attached opposingly-lying followers. When activating the endless element in the magazine rails, the followers—in the case of extended follower pins—convey a wall element from the guide rail into the magazine, respectively from the magazine into the guide rail of the room-space partition. In order to enable a trouble-free transfer from the magazine into the guide rail and/or from the guide rail into the magazine, the followers of the endless element of the magazine must be installed slightly higher or lower than those followers that are installed at the endless element of the guide rails.

Advantageous further developments of the invention are characterized by the features of the subclaims.

Described in more detail in the following with the aid of the drawing is an example of embodiment of the invention.

Figure 1:
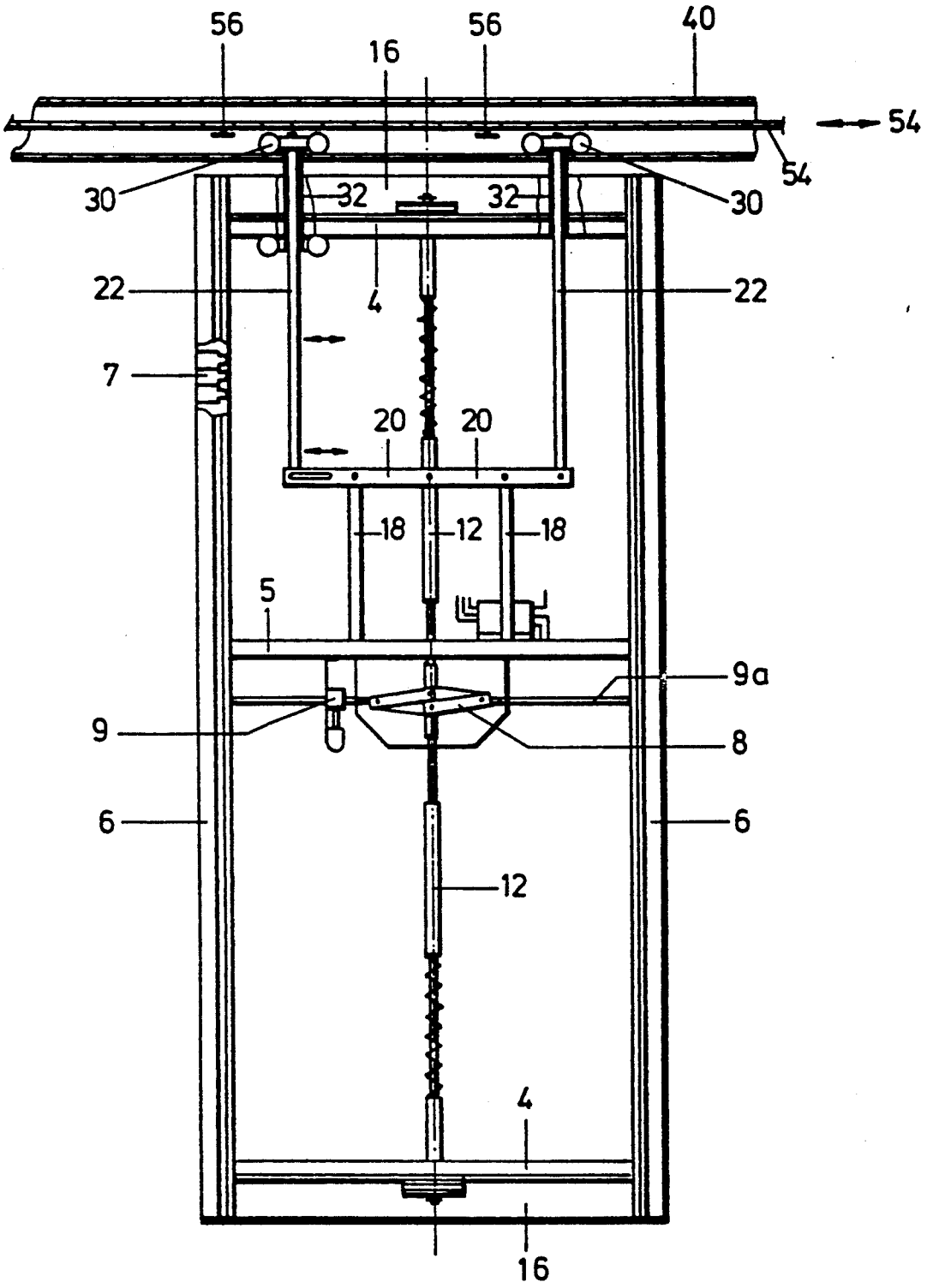
FIG. 1 shows a side view of a wall element, with cover plate omitted, and partially broken away guide rail.

Represented in FIG. 1 is a side view of a wall element 1 of the room-space partition. The wall element consists of a metal frame and two cover plates 2 attached on both sides thereof, with the cover plate facing toward the observer being omitted. The frame is formed of a top transverse spar 3, a bottom transverse spar 4 and a middle transverse spar 5 along with two interface profile strips 6 joining these latter. Attached at the top transverse spar 3 are carrier studs 32 at whose top ends are rotatably-journaled carrier members, in the present case constructed as bogie-wheel suspensions. Each bogie-wheel suspension is equipped in known manner per se with several roller pairs 31, which likewise in usual manner run on the running surfaces 46 of a guide rail 40 displaying a center slot 44 open toward the bottom, with the carrier studs 32 being guided through the center slot 44.

Disposed above the top transverse spar 3 as well as below the lower transverse spar 4 is one each sealing strip 16 that can be extended against the ceiling, respectively the floor, and again retracted into the wall. The linkage 12 ends at a scissors spreader 8 that can be brought into an expanded position by an electric motor 9, to which the sealing strips 16 are extended via the linkage 12. Scissors spreader 8, electric motor 9 and linkage 12 together form the sealing drive. The carrier studs 32 are constructed as bushings through each of which runs a perpendicular follower pin 22. Each one of the two follower pins 22 is hinged at the free end of a pivot lever 20 whose other end is hinged to the sealing strip linkage 12. The levers 20 are both hinged in the mid region to a supporting linkage 18 that is firmly fixed to the middle transverse spar 5. Then, when the scissors spreader 8 is spread by the motor 9 and the sealing strip linkages 12 thereby extend the sealing strips 16, the pivot levers 20 are simultaneously pivoted about the hinge points of the support linkages 18 such that the follower pins 22 are moved from their original, vertically-extended position downwardly into a retracted position. Conversely, when retracting the sealing strips 16, the follower pins 22 are extended vertically upwardly.

One of the carrier studs 32, and in FIG. 1 actually the left-hand carrier stud 32, is journaled in horizontally-displaceable fashion toward the other carrier stud 32, in the top transverse spar 3. In order that the follower pin 22 projecting through the displaceable carrier stud 32 be capable of following the displacement movement, provided at the lower end of this follower pin 22 is a lug that projects into an oblong hole 21 of the pivot lever 20 and allows a horizontal displacement of this follower pin 22.

Figure 2:
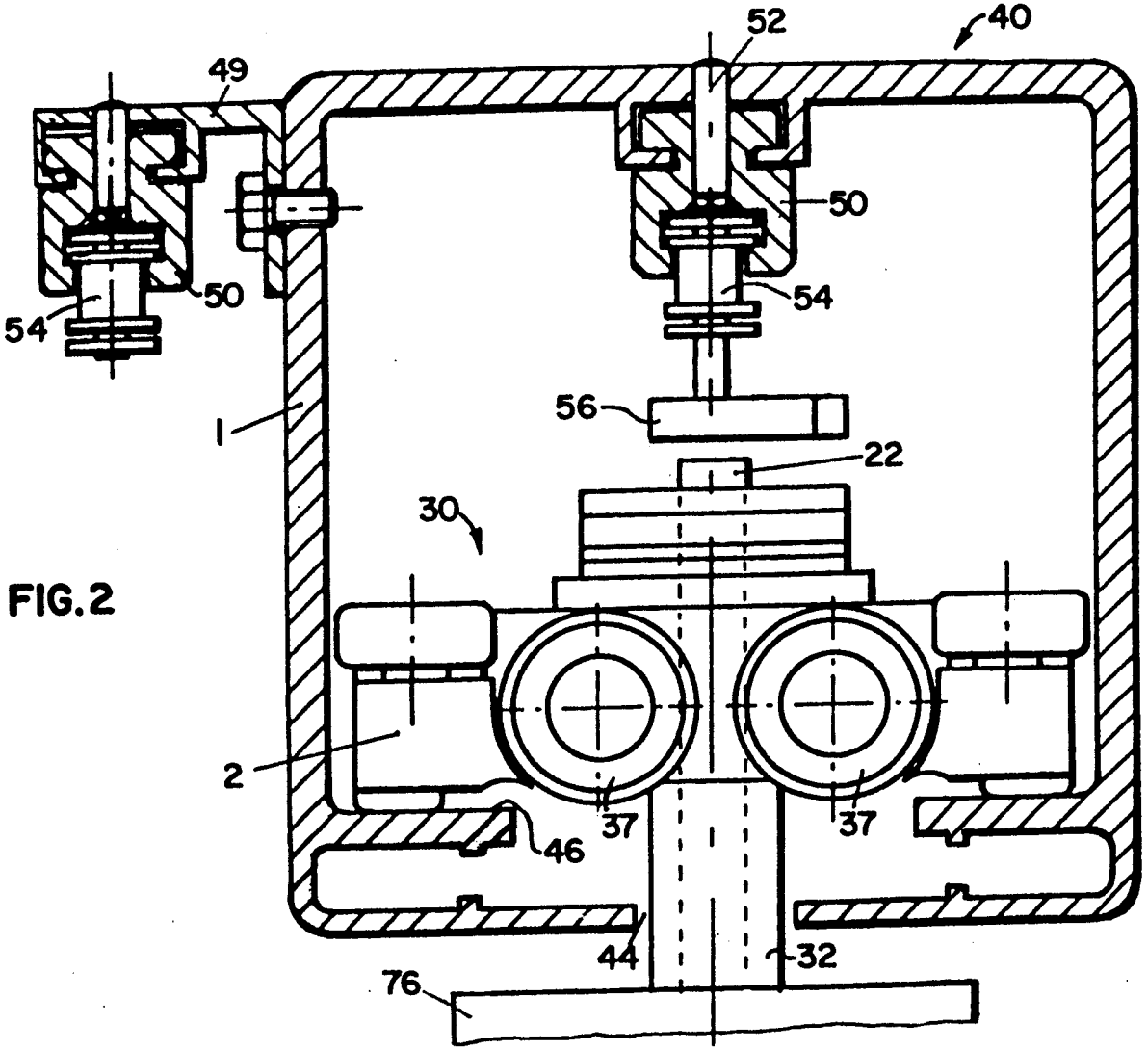
FIG. 2 shows a cross section through a guide rail in the case of partially-retracted follower pins.
Figure 3:
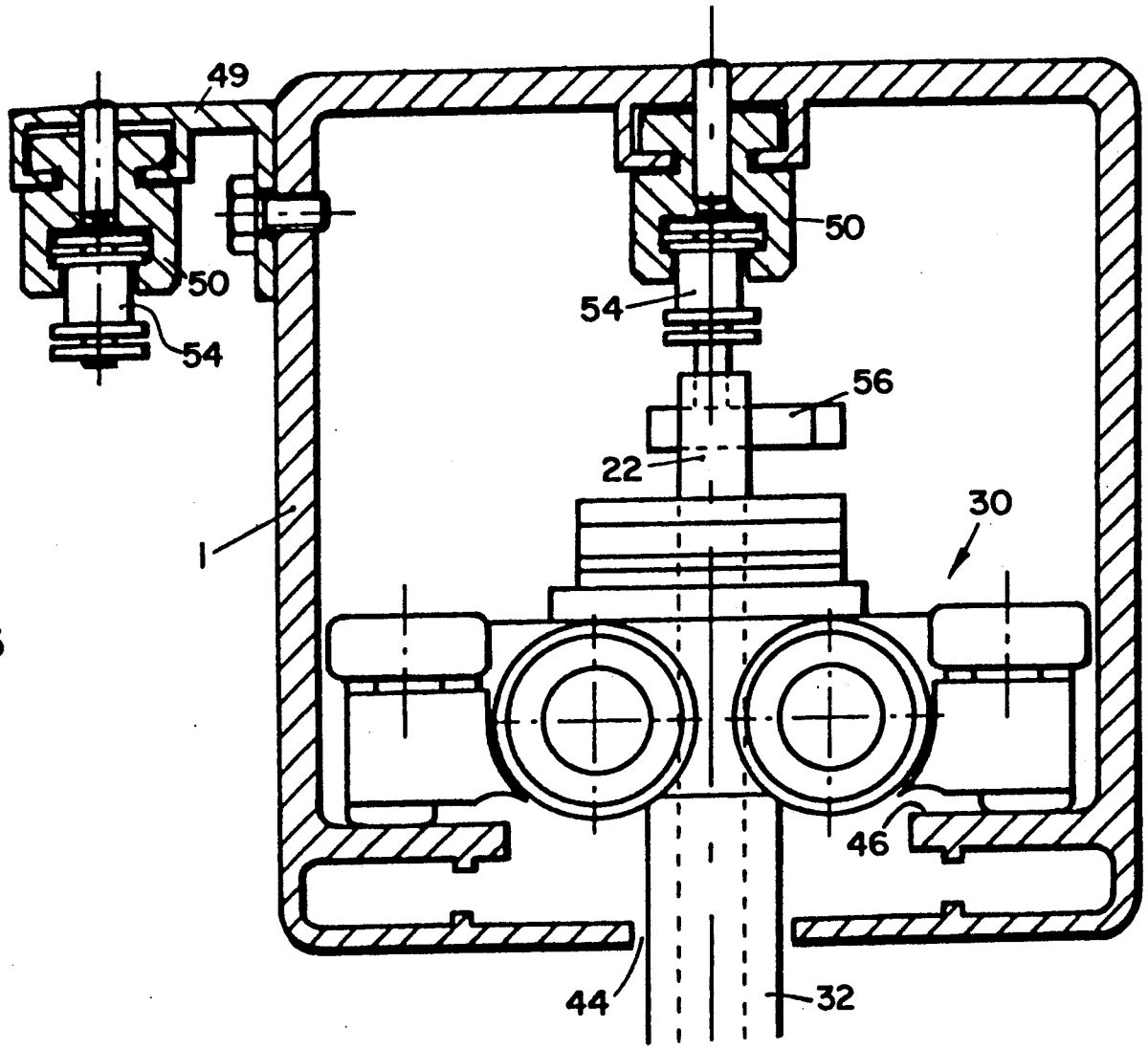
FIG. 3 shows a cross section based on FIG. 2 with extended follower pins.

As can be obtained in particular from the cross sections through the guide rail, FIGS. 2 and 3, as well as the schematic views onto the guide rail (FIGS. 5 to 7), provided in the guide rail 40 is a drivable, endless element 54 that revolves in the one or the other direction when a drive motor is driving the endless element 54. One stringer of the endless element 54, in the form of embodiment represented, runs about centrally in the guide rail, over the carrier member 30. The other stringer of the endless element 54 runs back outside the guide rail 40. In order to guarantee a precise, sag free running of the endless element 54, fixed in the guide rail is a slide profile 50 having a downwardly-directed opening. The endless element 54 is guided in the slide profile and projects downwardly with part of its cross section through the opening of the slide profile 50. The stringer of the endless element 54 running in the opposite direction likewise runs—outside the guide rail 40—in a slide profile 50 that is fixed to the guide rail 40 by means of an angle-bracket 49. Disposed at the beginning of the guide rail and at the end of the guide rail are reversing rollers 59, e.g. reversing pinions about which the endless element 54 revolves. One of the reversing rollers 59 is driven by the drive motor 55 whenever the endless element is to be set into a revolving movement.

Figure 5:
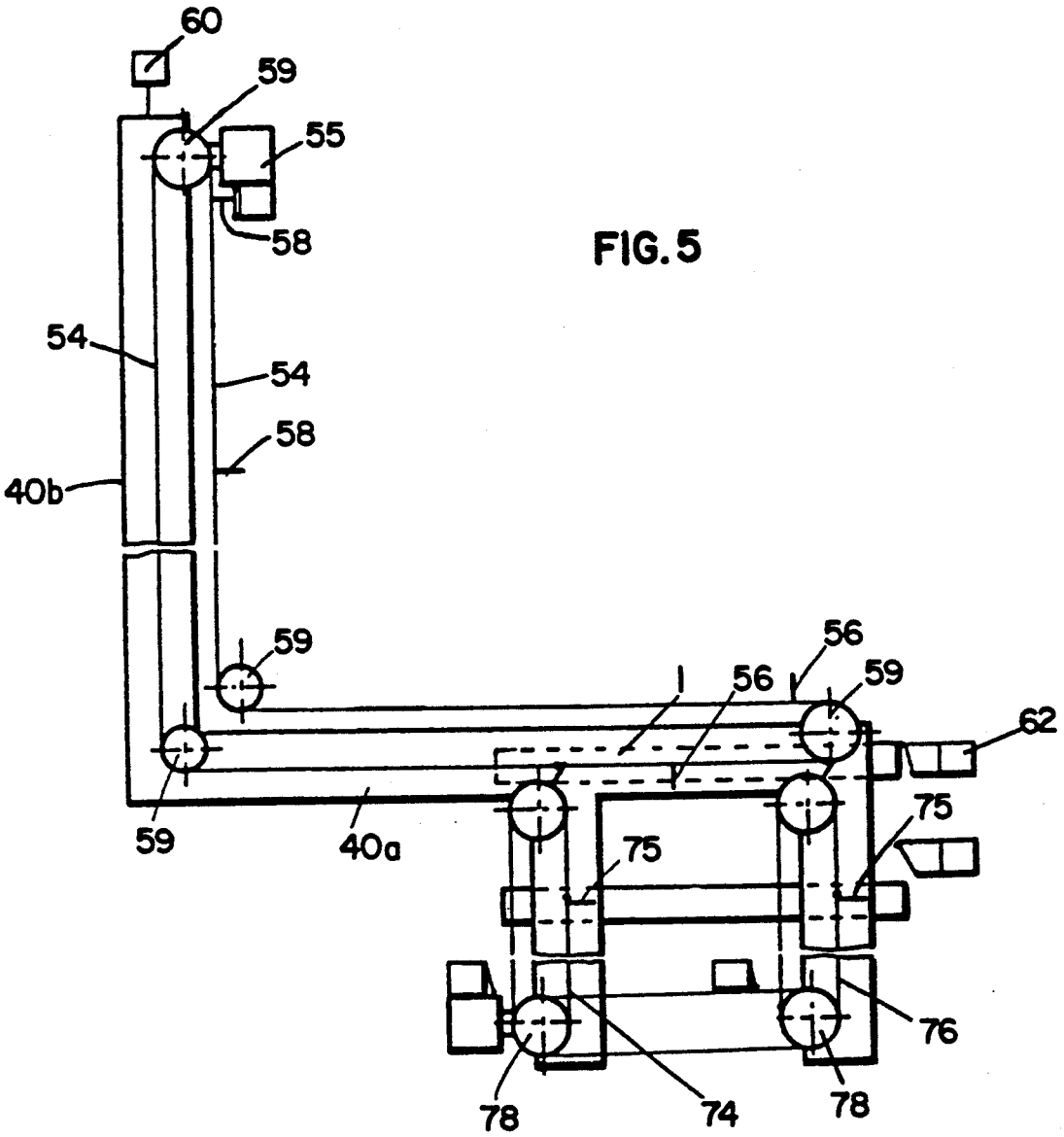
FIG. 5 shows a schematic view onto the guide rail of the room-space partition and the magazine at the beginning of construction the room-space partition.
Figure 6:
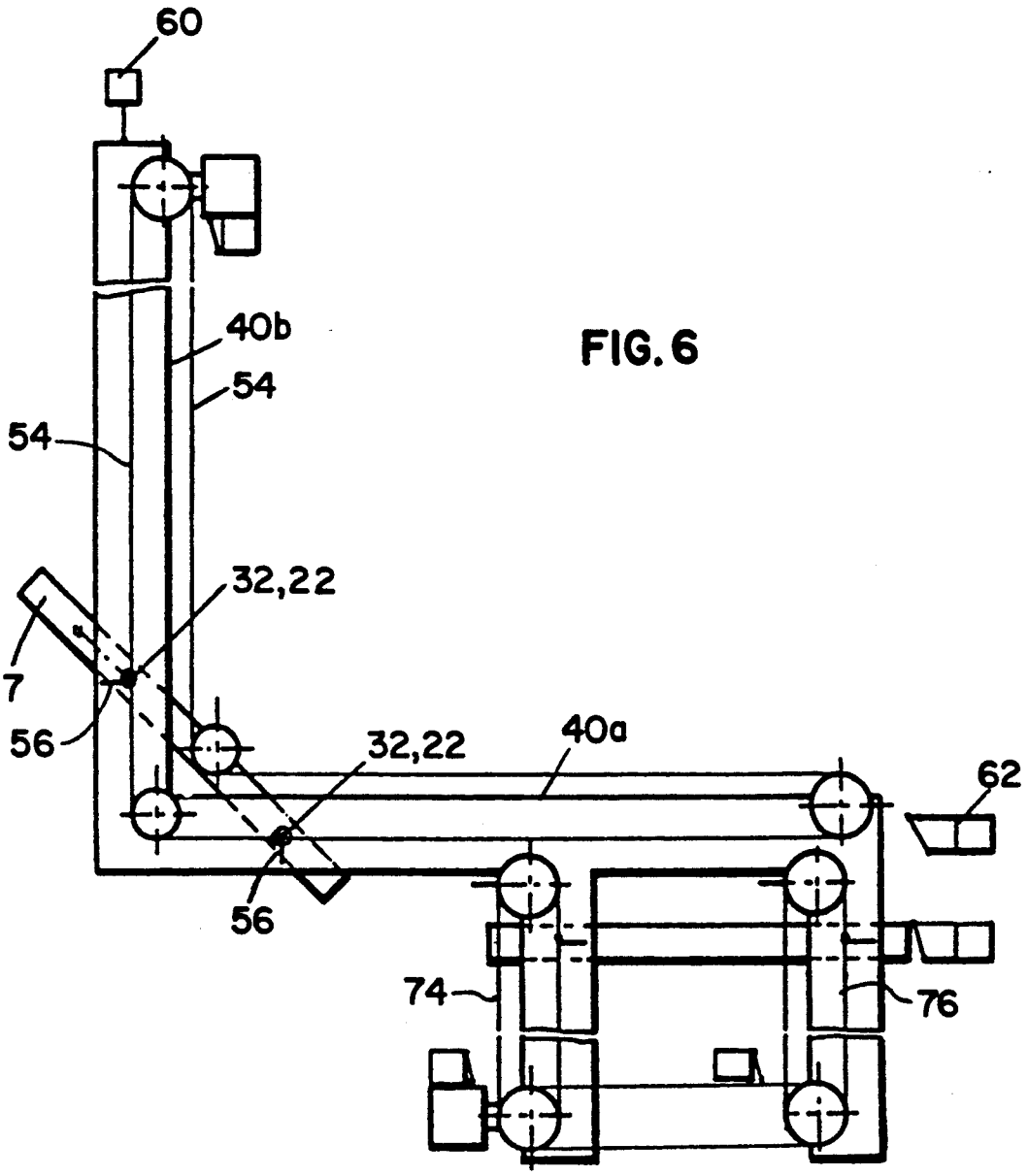
FIG. 6 shows a representation corresponding to FIG. 5 that shows the diagonal changeover control of the first wall element when constructing the room-space partition.
Figure 7:
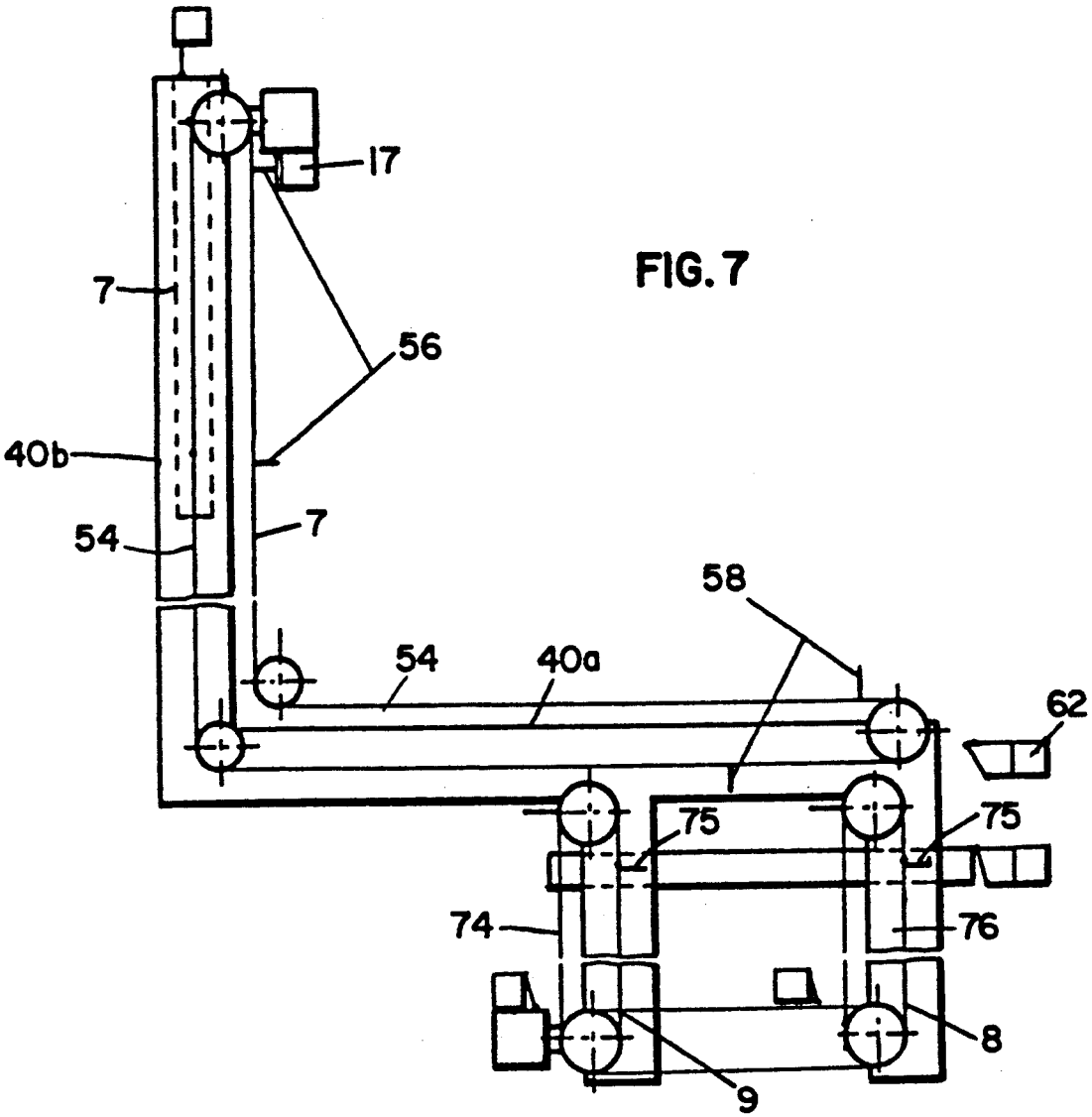
FIG. 7 shows a representation corresponding to FIG. 5 and 6, wherein the first wall element, after transporting, has reached the end position.

As can be obtained from FIGS. 5 to 7, the guide rail 40 can be made up of a first rail section 40*a* and a second rail section 40*b* that abut against one another at a predetermined angle and embody a corner in the pattern of the room-space partition. Both rail sections 40*a* and 40*b* are traversed by a common endless element 54 that is turned around, at the corner point 41 by means of a reversing pinion 59, from the first rail section 40*a* into the second rail section 40*b*.

Provided for "packaging" the wall elements is a magazine that contains two parallel rail sections 72, 74, which branch off perpendicularly from the guide rail 40 and display between them an interval that corresponds to the maximum distance between the carrier studs 32 of the wall elements 1. Also disposed in the two rail sections of the magazine 72 is one each endless element 74, 76 that revolves over reversing rollers 78. The rail sections 72 and the arrangement of the endless elements 74, 76 in the rail section 72 corresponds in general to the arrangement in accordance with FIGS. 2 and 3.

As can be obtained in particular from FIGS. 2 and 3, and schematically also from FIGS. 5 to 7, fixed to the endless element 54 running in the guide rail 40 are two followers 56, which extend downwardly by a small amount from the endless element 54 and then pass over into a flat element running horizontally, whose engagement edges 57 are convexly curved. The two followers 56 have a spacing between them that corresponds to the maximum interval between the two carrier studs 32 of a wall element. Fixed on the endless belt 54, at a predetermined distance from the followers 56, are two other followers 58, the interval between them likewise corresponding to the maximum distance between two carrier studs 32. Achieved by mounting two follower pairs 56, 58 is that one follower pair is situated in the region of the magazine and is ready for transport of the next wall element 1, after the second follower pair 58, in a preceding transport procedure, has moved one wall element and has run free of this wall element.

Fixed to the two parallel endless elements 74, 76 of the magazine 70, likewise lying opposite to each other, are followers 75.

The follower pins 22 running through the carrier studs 32 are extended vertically upwardly by the sealing drive—while the sealing strips are being simultaneously retracted into the wall element 1—until the follower pins 22 arrive into the revolution path of the followers 56, 58, respectively 75. Then, if the endless element 54 of the guide rails 40 and/or if the two endless elements 74, 76 of the magazine 70 are set into synchronous movement, then the followers 56, respectively 75 grip back of the follower pins 22, whereby the wall elements 1 are transported by the endless elements 54, respectively 74, 76. Transport of a wall element stops when the associated endless element, respectively elements, 54 and/or 74, 76 stop and the follower pins 22 are next again retracted. Accordingly, the endless element, respectively elements 54, 74, 76 for transport of another wall element can be reactivated, the followers 56, 58, respectively 75 then run unhindered past the retracted follower pins 22; compare FIG. 2.

Figure 4:
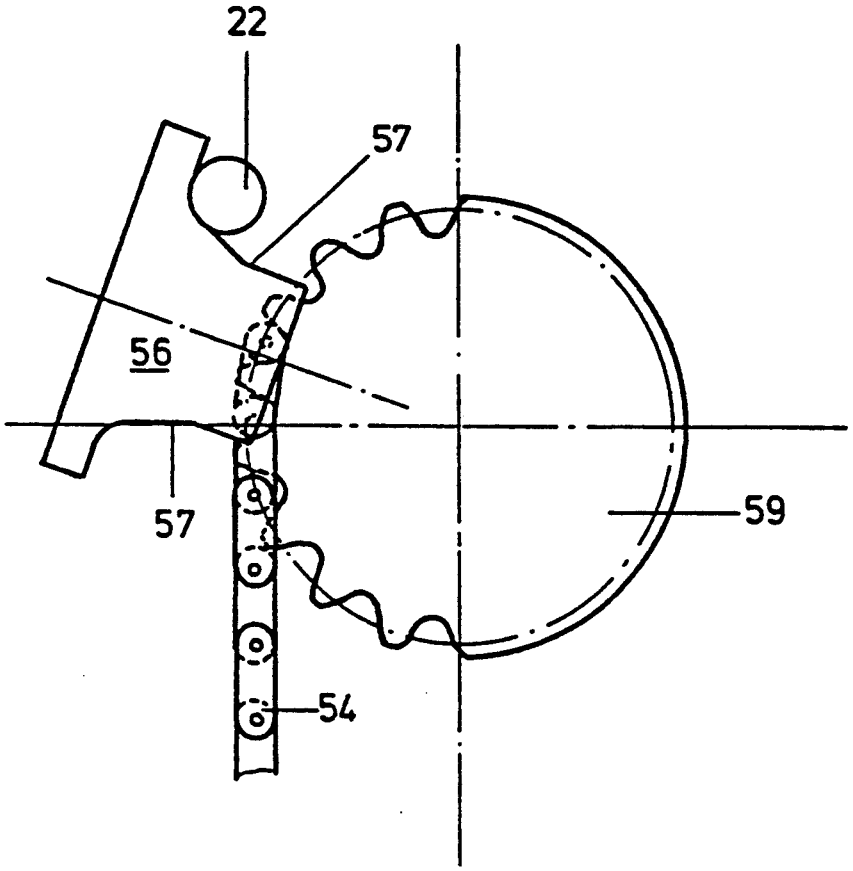
FIG. 4 shows a top view onto a follower that revolves about a reversing pinion.

FIG. 4 shows a top view onto a follower 56 that is fixed to an endless chain 54 that is turned around by a reversing pinion 59. As can be obtained from FIG. 4, the convex shaping of the following edge 57 of the follower simplifies reversal of the follower pins 22. In order that the transfer of the wall elements 1 from the magazine into the guide rails 40 proceed without problem, the followers 75 of the endless elements 74, 76 must be offset in height relative to one another with reference to the followers 56, 58 of the endless element 54.

Described in the following with the aid of FIGS. 5 to 7 is the conveying of a wall element 1 from the magazine 70 into the end position of the room-space partition.

First, the endless elements 74, 76 of the magazine 70 are set into synchronous revolving movement; in so doing they convey, with their followers 75, wall element 1, represented in broken lines, out from the magazine into the guide rail 40. When the wall element 1 reaches its position in the guide rail 40 that is represented with a broken line, a switch contact 62 is actuated by the wall element 1, which switches off the endless elements 74, 76 and sets the endless element 54 into revolving movement. After this, the followers 56 grip behind the two carrier lugs of the wall element 1, whereupon the wall element 1 is transported in the direction of rail section 40*a*, until the forward follower 56 is turned around at the reversing roller 49 into the rail section 40*b*, and in so doing introduces transport of the wall element diagonally. The feature of this diagonal movement is that the rear follower is transported at a constant speed in the rail section 40*a*, the forward follower being transported at the same constant speed in the rail section 40*b*. In order that this forced movement be capable of running off in trouble-free fashion, one of the two follower pins, in the example represented the forward follower pin, must be journaled in horizontally-displaceable fashion and be able to move relative to the other follower pin 22. Upon introduction of the diagonal movement, the forward follower pin 22 approaches the rear follower pin 22; at the end of the diagonal movement, the forward follower pin 22 then runs back again into its initial position in which the (one) follower pin 22 assumes its maximum distance away from the other follower pin. For realizing this equalizing movement, one of the carrier studs 32 is journaled in horizontally-displaceable fashion, and the follower pin 22 associated to this carrier stud 32 is, in the example of embodiment represented, guided through the carrier stud and therefore follows the movement of the carrier stud.

At the end of the diagonal movement, the rear follower 56 is likewise reversed at the reversing roller 59, into the direction of the rail section 40*b*; compare FIG. 6. Next, the wall element 1 is then conveyed along rail section 40*b*, up into the end position, and there, via the switch contact 60, switches off the drive motor 55 for the endless element 54. Then, the sealing drive is activated, which extends the sealing strips 16 against floor and ceiling and in so doing simultaneously pulls the follower pins 22 into the wall element. Then, a new transport process can start, wherewith another wall element can be conveyed out from the magazine into the guide rails and then along the guide rails up to against the first wall element.

As can be obtained in particular from FIGS. 1 and 2, the sealing strip 16 can be retracted by means of a manually-actuated spindle 9*a* until the wall element of concern can come free of the sealing rail while the follower pins 22 are still out of engagement with the followers 56. In this condition, the wall element can be manually conveyed, in order to maintain an emergency operation when electrical control circuits and/or drives are disturbed.

We claim:

1. Room-space partition comprising:

(a) a guide rail;

(b) an endless element located within the guide rail;

(c) displaceable wall elements, having perpendicular end faces, wherein each wall element comprising two carrier studs, with one carrier stud being horizontally displaceable toward the other carrier stud such that the spacing between the two carrier studs is variable between a minimum interval and a maximum interval, and wherein the displaceable wall elements are suspended by carrier members that are attached to the carrier studs, the carrier members being displaceable in the guide rails and rotatable about the carrier studs, and wherein the wall elements are movable along their perpendicular end faces in sealing contact against one another;

(d) two followers, each follower fixed on the endless element at a spacing corresponding to a maximum interval between the carrier studs of the wall element; and (e) two follower pins disposed on the carrier members and releasably engageable with the followers, which are vertically movable between a retracted position and an extended position, wherein the follower pins come into releasable engagement with the followers when in the extended position.

2. Room-space partition according to claim 1, wherein the endless element comprises a first stringer running in the guide rail over the carrier members, and a second stringer guided outside of the guide rail in a counter-running manner.

3. Room-space partition according to claim 1, wherein a pair of first followers is located at a predetermined distance from a second pair of followers.

4. Room-space partition according to claim 1, wherein the wall elements comprise horizontal end faces and sealing strips located on the horizontal end faces of the wall elements that are capable of being extended in contact against the floor and the guide rails or the ceiling of the room.

5. Room-space partition according to claim 1, wherein the carrier studs are constructed as bushings through which the follower pins run in a vertically-displaced fashion.

6. Room-space partition according to claim 2, wherein the first stringer of the endless element, which runs within the guide rail, is guided in a downwardly open slide profile.

7. Room-space partition according to claim 1, wherein the endless element is an endless chain, an endless cable, or a belt.

8. Room-space partition according to claim 1, wherein the endless element is a roller chain.

9. Room-space partition according to claim 1, wherein the room-space partition further comprises sealing strips and a common drive, and wherein the sealing strips and the follower pins are capable of being extended and retracted by the common drive.

10. Room-space partition according to claim 9, wherein when retracting and extending the sealing strips the following pins are in turn opposingly extended and retracted.

11. Room-space partition according to claim 1, wherein the followers are constructed as flat elements with horizontal extensions having two following edges lying in opposing fashion to one another and being convexly formed.

12. Room-space partition according to claim 1, wherein the room-space partition further comprises wall-fast switch contacts that are disposed at the beginning and end positions of the room-space partition and a drive motor for driving the endless element, which, when actuated by means of a wall element, stop the drive motor of the endless element.

13. Room-space partition according to claim 12, wherein the switch contacts are disposed on the vertical end faces of the wall elements and are arranged and configured such that the switch contacts activate a sealing drive and stop the drive of the endless element upon coming into contact with the fixed wall element.

14. Room-space partition according to claim 1, wherein the guide rails contain first and second cornering rail sections, and that a common endless element runs in both rail sections, and are turned around at a corner bracket from the first rail section into the second rail section by reversing rollers.

15. Room-space partition according to claim 1, wherein a separate endless element revolves for each section of guide rail and that the followers of each endless element are arranged and configured at a different height than the followers of the endless element of the adjacent rail section.

* * * * *